US007374126B2

(12) United States Patent
Kohlenberg et al.

(10) Patent No.: US 7,374,126 B2
(45) Date of Patent: May 20, 2008

(54) CABLE GUIDE OF A CABLE WINCH

(75) Inventors: Thomas Kohlenberg, Paderborn (DE); Josef P. Saeftel, Castrop-Rauxel (DE)

(73) Assignee: Demag Cranes & Components GmbH, Wetter (DE)

( * ) Notice: Subject to any disclaimer, the term of this patent is extended or adjusted under 35 U.S.C. 154(b) by 45 days.

(21) Appl. No.: 11/537,284

(22) Filed: Sep. 29, 2006

(65) Prior Publication Data

US 2007/0075174 A1 Apr. 5, 2007

(30) Foreign Application Priority Data

Sep. 30, 2005 (DE) ..... 10 2005 046 900

(51) Int. Cl.
*B66D 1/28* (2006.01)

(52) U.S. Cl. ..... 242/397.3; 242/483; 254/284

(58) Field of Classification Search ..... 242/483, 242/483.1, 483.2, 483.7, 602.1, 397.3; 254/254, 254/285

See application file for complete search history.

(56) References Cited

U.S. PATENT DOCUMENTS 1,782,358 A * 11/1930 Lang ..... 242/483
1,973,446 A * 9/1934 Resenquist ..... 242/483
2,348,987 A * 5/1944 Lock ..... 242/157.1
3,226,090 A * 12/1965 Sauerbrey ..... 254/284
3,671,016 A * 6/1972 Gladysz ..... 242/157.1
4,634,078 A 1/1987 Kaufmann et al.
5,335,895 A * 8/1994 Sell ..... 254/271
5,482,219 A * 1/1996 Tcholakov ..... 242/397.3
5,494,235 A * 2/1996 Vowles ..... 242/390.3

FOREIGN PATENT DOCUMENTS

DE 542 451 C 2/1932
DE 34 21 843 C3 12/1985

* cited by examiner

*Primary Examiner*—Evan Langdon
(74) *Attorney, Agent, or Firm*—Van Dyke, Gardner, Linn & Burkhart, LLP

(57) ABSTRACT

A cable guide of a cable winch, such as a cable hoisting winch, includes a cable drum having at least one cable groove and a cable guide having at least two base segments expanding into a ring. The two base segments are guided in the cable groove by at least one engaging element and are supported against the cable winch by at least one torque support. Elements for guiding and holding down a cable are arranged on the base segments. To create a simplified and optionally modular design of a cable guide, the base segments may be configured such that at least one torque support and at least one add-on element for guiding and holding down a cable can be secured in a desired arrangement on the base segments.

30 Claims, 3 Drawing Sheets

CABLE GUIDE OF A CABLE WINCH

FIELD OF THE INVENTION

The present invention relates generally to a cable guide of a cable winch, and particularly to a cable hoisting winch.

BACKGROUND OF THE INVENTION

From German patent DE 34 21 843 C3 there is already known a winch with a cable drum, having a cable guide for a cable which can be wound on the drum. The cable drum has a right or left-handed groove for the cable. In order to securely lead the cable into the cable grooves during the winding and paying out, and hold it there when the cable is slack, the cable guide performs a guiding function and a holding down function in relation to the cable. The cable guide is basically configured as a ring, which is guided on the cable grooves and thus in the lengthwise direction of the cable drum. The ring is divided roughly in half, into two segments, of which the first is designated the guide segment and the second the hold-down segment. Both segments are provided with a threaded profile at their inner circumferential surface, matching the profile of the cable groove, including its pitch. The divided ring is placed on the cable drum; the threaded profile can then engage in the cable groove and the ends of the segments are joined together by a screw connection. So that the ring does not turn with the cable drum, but instead migrates along the cable drum in its lengthwise direction when the cable is being wound up or paid out, the ring thrusts by means of a torque support in the form of a short arm against a profile of the winch, which runs parallel to the lengthwise direction of the cable drum at a distance from the cable grooves of the drum.

This design has worked well in many applications. The guide segment and the hold-down segment are each suited to different tasks and therefore differ in construction. This increases the diversity of parts for the cable guide. Furthermore, the segments of the cable guide are made of plastic. Accordingly, a special injection molding die is required for the guide segment and the hold-down segment. As the diameter of the cable drum becomes larger, the segments also grow in size, as do the tooling costs.

Based on this prior art, the problem identified is creating a cable guide of a cable winch, such as a cable hoisting winch, which has a simplified and modular construction.

SUMMARY OF THE INVENTION

According to the invention, a cable guide of a cable winch, such as a cable hoisting winch, includes a cable drum, having at least one cable groove. The cable guide has at least two base segments expanding into a ring, which are guided in the cable groove by at least one engaging element and supported against the cable winch by a torque support. Elements for guiding and holding down a cable are arranged on the base segments. The base segments are configured such that at least one torque support and at least one add-on element for guiding and holding down a cable are arranged in a desired number variably on the base segments. Each individual component is of rather simple configuration in itself and is adapted to perform a function. A modular construction of the cable guide is achieved. The cable guide is easily adapted to accommodate the particular local circumstances, such as installation position of the cable winch and location of the cable pay-out point.

Because the base segments are identical except for the engaging elements, the diversity of parts can be reduced. Because only one basic die is required, production by plastics injection molding is simplified. The engaging elements which differ from each other can be produced by using gates or interchangeable inserts in the basic die during manufacturing. This benefit is maximized for large cable drum diameters and correspondingly large base segments.

A stable guiding of the base segments along the cable drum is achieved in that the engaging elements of the base segments are configured as threads adapted to the contour of the cable groove. This guide is optimized when the engaging elements extend over the inner surface of the base segments facing the cable drum and at least two segments of the threads are provided one after the other in the lengthwise direction of the cable drum.

A further simplification and reduction of parts is achieved in that the at least one add-on element for guiding the cable is identical in configuration to the at least one add-on element for holding down the cable, regardless of function. Preferably, the at least one add-on element has a toroidal shape with two legs and a cross piece joining them.

With the at least one add-on element, an opening for guiding the cable can be bounded off by one section of the base segments, through which the cable being guided is then led in the region of the cable pay-out point. The inner surface of the at least one add-on element facing the cable drum can also be used simply to hold down the cable.

Another modular component which is provided is a guide element, by which the cable is pressed into the cable groove in the proximity of the cable pay-out point. Thus, different cable pay-out positions can be realized by simply changing the guide element and the at least one add-on element. Thus, the cable guide has more universal applications. It is also possible to employ several guide elements.

For the fastening of the guide element, at least one bore running in the lengthwise direction of the cable drum is arranged in the base segments, into which one axis of the guide element can be inserted and clamped. To enable the guide element to be variably secured at different positions on the base segments, the base segments include more bores for the guide element than are required for definite fastening.

To simplify installation, bores are arranged in the base segments running in the lengthwise direction of the cable drum for fastening of the at least two add-on elements and the at least one torque support. In order to enable the at least two add-on elements and the at least one torque support to be variably secured at different positions on the base segments, the base segments include more bores for the at least two add-on elements and the at least one torque support than are required for definite fastening.

Optionally, at least the base segments are made of plastic, in particular, a polyamide with an admixture of $MoS_2$, which results in the base segment having good wearing and sliding properties.

These and other objects, advantages, purposes and features of the present invention will become apparent upon review of the following specification in conjunction with the drawings.

DESCRIPTION OF THE PREFERRED EMBODIMENTS

Figure 1:
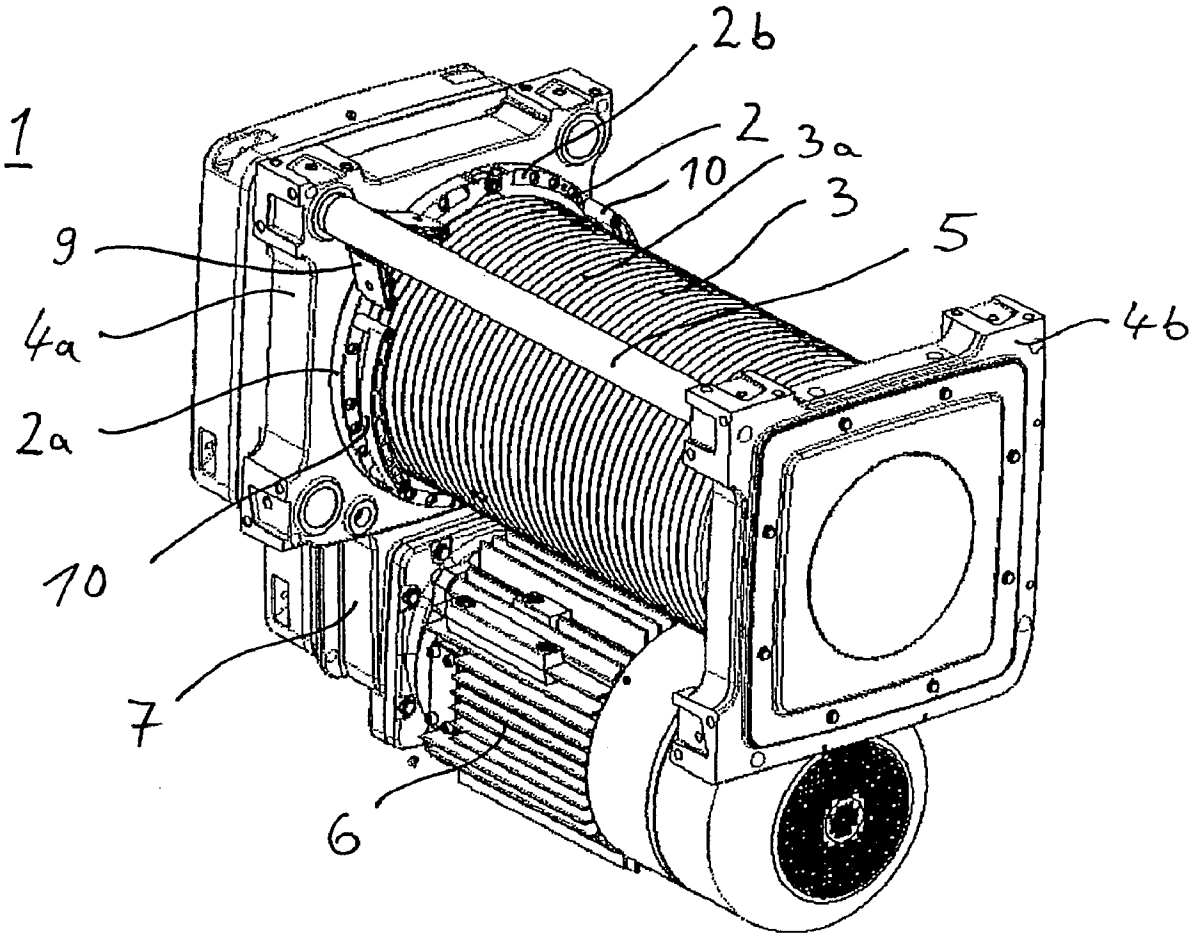
FIG. 1 is a perspective view of a cable block with a cable guide.

Referring now to the drawings and the embodiments illustrated therein, FIG. 1 shows a perspective view of a cable block 1 with a cable guide 2 according to the invention. The cable block 1 comprises a cable drum 3 with a cable groove 3*a* for a hauling cable, not shown, as well as a first support plate 4*a* and a second support plate 4*b*, between which the cable drum 3 is mounted and is able to turn. The approximately square support plates 4*a* and 4*b* are joined together and spaced from each other by two tubular lengthwise girders 5. (The second girder 5 is concealed by the cable drum 3 in FIG. 1). The ends of lengthwise girders 5 are fastened in the corner regions of the support plates 4*a*, 4*b*. The two lengthwise girders 5 are secured at opposite corners of the support plates 4*a*, 4*b*. Cable drum 3 is driven by an electric motor 6, which is joined to the cable drum 3 by a gearbox 7. Gear box 7 thrusts against the side of the first support plate 4*a*, away from cable drum 3.

Cable guide 2 has the shape of a ring and includes two nearly identical first and second base segments 2*a* and 2*b*, which are each in the shape of a semicircle. The ring-shaped cable guide 2 embraces cable drum 3 and engages the cable groove 3*a* by at least one engaging element 8 (see FIG. 2), which is arranged on the inner circumferential surface 2*c* of the base segments 2*a* and 2*b*. Thus, cable guide 2 is able to move like a threaded nut along a screw or a spindle. In this case, the cable guide 2 is able to move along cable drum 3. To prevent cable guide 2 from turning along with the cable drum 3 when the cable is being wound up or paid out, i.e., when cable drum 3 is turning, a torque support 9 is fastened on one of the two base segments 2*a*, 2*b* of the cable guide 2. The torque support 9 engages one of the two tubular lengthwise girders 5 by a semicircular recess 9*a*. Thus, cable guide 2 can effectively hold down and guide the cable and can move along the cable drum 3. Cable guide 2 in FIG. 1 is in its left hand end position. So that the cable guide 2 can hold down the cable and guide it while the cable is being wound up or paid out, as described above, suitable add-on elements 10 and additionally a guide element 11 are fastened accordingly on its base segments 2*a* and 2*b*.

Figure 2:
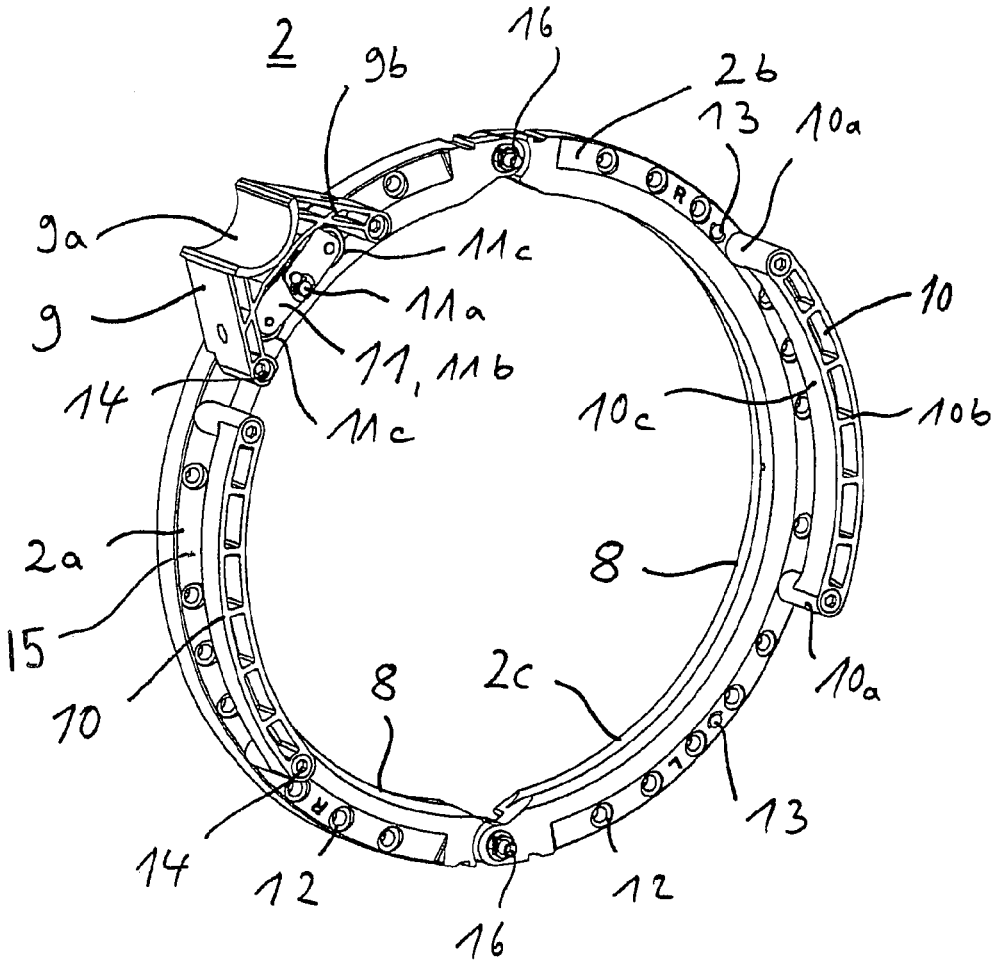
FIG. 2 is a perspective view of the cable guide per FIG. 1.

FIG. 2 shows a perspective view of a cable guide 2 per FIG. 1. In particular, the engaging elements 8, which are arranged on the inner circumferential surface 2*c* of the base segments 2*a* and 2*b*, are in the form of segments of two consecutive threads, which are complemented by the contour of the cable groove 3*a*. The threads extend over almost the entire inner circumferential surface 2*c* of the base segments 2*a* and 2*b* and do not terminate until the region of the ends 2*d* of the base segments 2*a* and 2*b*. The engaging elements 8 of the two base segments 2*a* and 2*b* differ from each other according to the pitch of the cable groove 3*a* of the cable drum 3, since they engage with different regions of the cable groove 3*a* in the lengthwise direction of the cable drum 3. Apart from the engaging elements 8, the base segments 2*a* and 2*b* are identical in configuration. Thus, when the base segments 2*a* and 2*b* are made from plastic in an injection molding process, the same injection mold can be used to make the base segments 2*a* and 2*b*. Only the region of the engaging elements 8 needs to be changed, which can be accomplished by using a so-called gate or interchangeable inserts, depending on whether the first base segment 2*a* or the second base segment 2*b* is being produced. Optionally, the plastic used may be a polyamide with admixture of $MoS_2$, which achieves good wearing and sliding properties for the base segments 2*a* and 2*b*, with the thread-like engaging elements 8 in the cable groove 3*a* and the cable drum 3 being made of steel.

Furthermore, two different kinds of first bores 12 and second bores 13 are arranged in base segments 2*a* and 2*b*, each of them extending in the lengthwise direction of the cable drum 3. Each base segment 2*a*, 2*b* is provided with first bores 12, which are arranged nearly uniformly over the circumferential direction of base segments 2*a*, 2*b*. The number and distribution of the first bores 12 is chosen such that the torque supports 9 and the add-on elements 10 for guiding and holding down the cable can be secured in suitable positions on the first and second base segment 2*a*, 2*b*. Suitable positions usually depend on the pay-out point of the cable from the cable drum 3 and the arrangement of the lengthwise girders 5 for buttressing the torque supports 9 on the support plates 4*a* and 4*b*. In FIG. 1, the cable block is a hoisting machine and thus the pay-out point of the cable, as also for the cable guide in FIG. 2, is situated roughly in the region of 270 degrees in the lengthwise direction of the cable drum 3. Accordingly, the add-on element 10 on the first base segment 2*a* has a guiding function for the cable, i.e., cable is guided through the arc-shaped opening 15 bounded by the add-on element 10 and the first base segment 2*a* toward and away from the cable drum 3. In the wind-up direction of the cable, 50 degrees from the middle of the add-on element 10 having the guiding function, add-on element 10 is followed by a torque support 9, fastened on the first base segment 2*a*, which is likewise secured by connection means 14 in the first bores 12. In the lengthwise direction of the cable drum 3, torque support 9 has an essentially V-shaped form, and the end regions of slanting arms 9*b* are fastened to the first base segment 2*a*. The above-described opening 9*a* is situated in the region where the arms 9*b* intersect.

Furthermore, each of the base segments 2*a*, 2*b* has two second bores 13, which are distributed nearly uniformly on the circumference of the entire cable guide 2. Each bore 13 is positioned between two first bores 12, serving to fasten the torque supports 9. Second bores 13 are configured as blind holes and serve to receive and clamp the axis of a guide element 11, which presses the cable into the cable groove 3*a* as it runs in and out. Two rollers 11*c* are mounted by a double lever 11*b* on the axis 1 la, having a level running surface. Although torque support 9 and guide element 11 are arranged on one side of the base segment 2*a* in the drawing, they can also be fastened elsewhere on base segments 2*a*, 2*b*, depending on circumstances or requirements of cable block 1. Several torque supports 9 or guide elements 11 may also be secured to the base segments 2*a*, 2*b*.

Because of the variable fastening possibility of torque supports 9, add-on elements 10 and guide element 11 on the base segments 2*a*, 2*b*, the cable guide 2 may be optimally adapted to the cable block 1 and the pay-out point of the cable. The number of elements built on can also be varied as needed.

On the second base segment 2*b*, in the circumferential direction, an additional add-on element 10 may be arranged. However, the additional add-on element has a hold-down function in relation to the cable, i.e., the cable is prevented from leaving the cable groove 3*a* by the inner side 10*c*, facing the cable drum 3. In FIG. 2, only one add-on element 10 having a hold-down function is built onto the second base segment 2*b*. However, it is possible to mount two add-on elements 10 having a hold-down function, positioned one behind the other in the circumferential direction of the base segment 2*b*. There is sufficient room for this configuration, and the first bores 12 are provided in the corresponding positions on the base segment 2*b* to accommodate this configuration.

Optionally, add-on elements 10 may be configured such that they provide the guiding function for the cable in the region of the pay-out point from the cable drum 3, or the hold-down function in the other region of the cable drum 3. The add-on elements 10 have the general shape of a toroidal strap with two boltlike legs 10*a* and a cross piece 10*b* bent according to the curvature of the base segments 2*a*, 2*b*.

At the ends 2*d* of the base segments 2*a*, 2*b*, additional bores 2*e* are arranged in order to screw together the base segments 2*a*, 2*b* into a ring by means of connectors 16, in the manner of a single-shear screw connection. Multiple-shear bolt connections are also possible.

Figure 3:
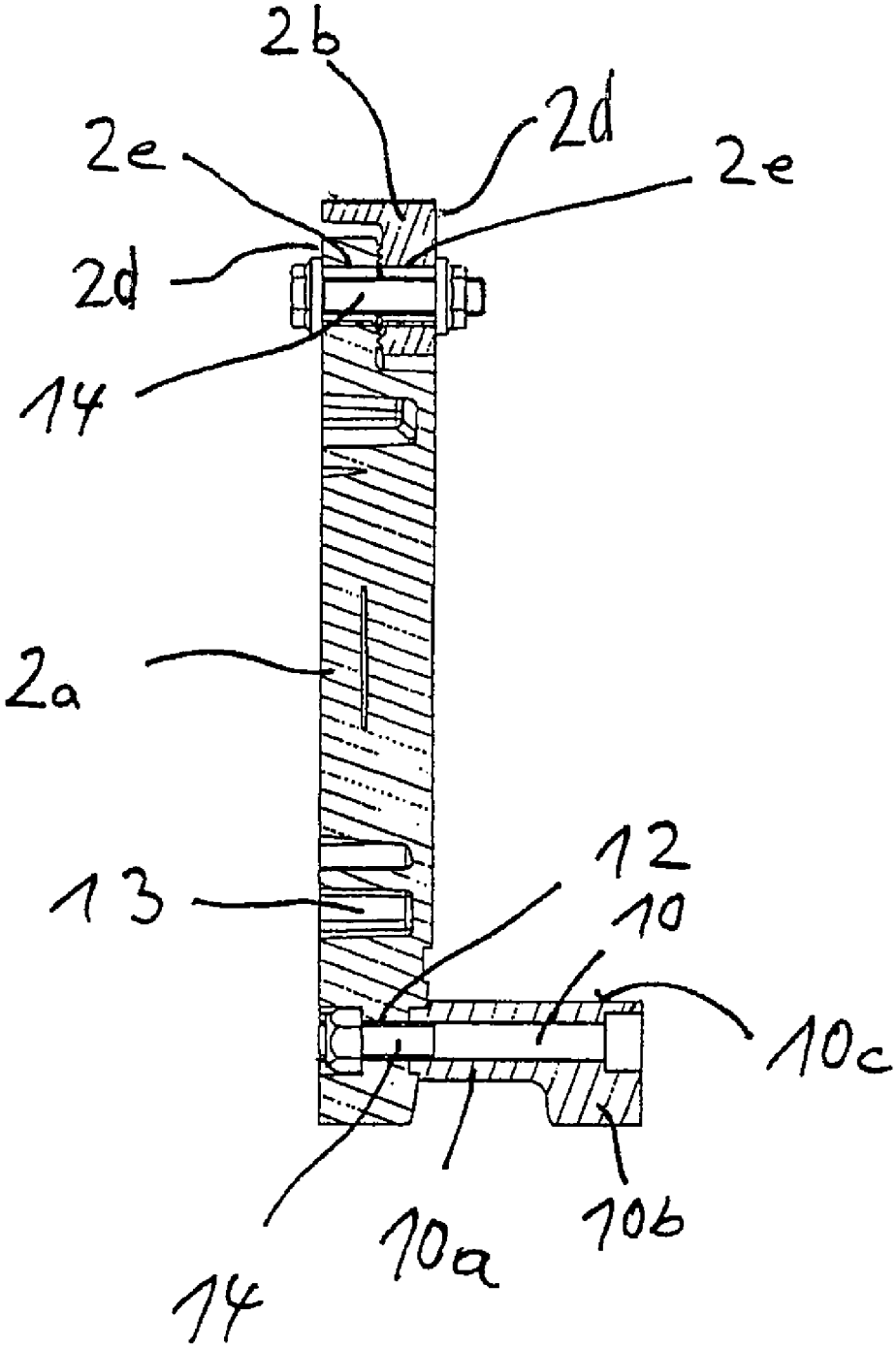
FIG. 3 is a sectional view of the cable guide per FIG. 2.

FIG. 3 shows a cross sectional view of a piece of the first base segment 2*a* per FIG. 2. The piece shown starts at the lower end 2*d* and ends in the region of one of the first bores 12, at which is fastened the beginning of an add-on element 10 with a connector 14 configured as a screw. As can be seen in FIG. 3, the ends of the legs 10*a* facing the base segment 2*a* are slightly extended in the manner of pins, in order to be inserted into an appropriately configured widening of the bore 12 for form fitting. Because add-on element 10 is aligned in this way, base segment 2*a* and the connector 14 may be more easily mounted, such that installation is made easier. This connection also has greater stability to transverse forces.

Although the above-described sample embodiment includes a cable guide having two nearly identical and semicircular base segments 2*a* and 2*b*, it is also possible to divide these into more than two nearly identical base segments. Cable drum 3 may also have more than one cable groove 3*a*. The number of cable guides 3 will then be increased correspondingly.

Changes and modifications in the specifically described embodiments can be carried out without departing from the principles of the invention which is intended to be limited only by the scope of the appended claims, as interpreted according to the principles of patent law including the doctrine of equivalents.

The embodiments of the invention in which an exclusive property or privilege is claimed are defined as follows:

1. A cable guide of a cable winch including a cable drum having at least one cable groove, wherein the cable guide has at least two base segments forming a ring, said base segments being guided in the at least one cable groove by at least one engaging element and being supported against the cable winch by at least one torque support, wherein at least one add-on element for guiding and holding down a cable is arranged on each of said base segments; and wherein said at least one torque support and said at least one add-on element for guiding and holding down said cable are variably arranged on said base segments, wherein a plurality of bores are arranged in said base segments, wherein said at least one torque support and said at least one add-on element in each of said base segments and are adapted to be selectively secured at the bores at different positions on the base segments.

2. The cable guide per claim 1, wherein the base segments are identical except for their engaging elements.

3. The cable guide per claim 2, wherein the engaging elements of the base segments are configured as threads adapted to the contour of the cable groove.

4. The cable guide per claim 3, wherein the engaging elements extend over an inner surface of the base segments facing the cable drum and at least two segments of the threads are provided one after the other in the lengthwise direction of the cable drum.

5. The cable guide per claim 4, wherein the at least one add-on element for guiding the cable is identical in configuration to the at least one add-on element for holding down the cable.

6. The cable guide per claim 5, wherein the at least one add-on element has a toroidal shape with two legs and a cross piece joining said two legs.

7. The cable guide per claim 6, wherein the at least one add-on element for guiding the cable bounds an opening with a section of the base segments, wherein the cable is led through said opening in the region of a cable pay-out point.

8. The cable guide per claim 7, wherein the at least one add-on element for holding down the cable holds the cable in the cable groove by an inner surface of the cable facing the cable drum.

9. The cable guide per claim 8, wherein the cable guide includes a guide element for pressing the cable into the cable groove in the proximity of the cable pay-out point.

10. The cable guide per claim 9, wherein at least one bore running in the lengthwise direction of the cable drum is arranged in the base segments for fastening the guide element.

11. The cable guide per claim 10, wherein a plurality of bores for the guide element are arranged in the base segments, by which the guide element can be secured at different positions on the base segments.

12. The cable guide per claim 11, wherein said plurality of bores arranged in the base segments for fastening the at least one add-on element and the at least one torque support run in the lengthwise direction of the cable drum.

13. The cable guide per claim 12, wherein at least the base segments are made of plastic, wherein said plastic is a polyamide with an admixture of $MoS_2$.

14. The cable guide per claim 1, wherein the engaging elements of the base segments are configured as threads adapted to the contour of the cable groove.

15. The cable guide per claim 14, wherein the engaging elements extend over an inner surface of the base segments facing the cable drum and at least two segments of the threads are provided one after the other in the lengthwise direction of the cable drum.

16. The cable guide per claim 14, wherein the at least one add-on element for guiding the cable is identical in configuration to the at least one add-on element for holding down the cable.

17. The cable guide per claim 16, wherein the at least one add-on element has a toroidal shape with two legs and a cross piece joining said two legs.

18. The cable guide per claim 16, wherein the at least one add-on element for guiding the cable bounds an opening with a section of the base segments, wherein the cable is led through the opening in the region of a cable pay-out point.

19. The cable guide per claim 16, wherein the at least one add-on element for holding down the cable holds the cable in the cable groove by an inner surface of the cable facing the cable drum.

20. The cable guide per claim 19, wherein the cable guide includes a guide element for pressing the cable into the cable groove in the proximity of the cable pay-out point.

21. The cable guide per claim 19, wherein said plurality of bores arranged in the base segments for fastening the at least one add-on element and the at least one torque support run in the lengthwise direction of the cable drum.

22. The cable guide per claim 1, wherein the at least one add-on element for guiding the cable is identical in configuration to the at least one add-on element for holding down the cable.

23. The cable guide per claim 22, wherein the at least one add-on element has a toroidal shape with two legs and a cross piece joining said two legs.

24. The cable guide per claim 1, wherein the at least one add-on element for guiding the cable bounds an opening with a section of the base segments, wherein the cable is led through said opening in the region of a cable pay-out point.

25. The cable guide per claim 1, wherein the at least one add-on element for holding down the cable holds the cable in the cable groove by an inner surface of the cable facing the cable drum.

26. The cable guide per claim 1, wherein the cable guide includes a guide element for pressing the cable into the cable groove in the proximity of the cable pay-out point.

27. The cable guide per claim 26, wherein at least one bore running in the lengthwise direction of the cable drum is arranged in the base segments for fastening the guide element.

28. The cable guide per claim 27, wherein a plurality of bores for the guide element are arranged in the base segments, by which the guide element can be secured at different positions on the base segments.

29. The cable guide per claim 1, wherein said plurality of bores arranged in the base segments for fastening the at least one add-on element and the at least one torque support run in the lengthwise direction of the cable drum.

30. The cable guide per claim 1, wherein at least the base segments are made of plastic, wherein said plastic is a polyamide with an admixture of $MoS_2$.

* * * * *